United States Patent [19]

Gross

[11] 4,240,318

[45] Dec. 23, 1980

[54] PORTAMENTO AND GLIDE TONE GENERATOR HAVING MULTIMODE CLOCK CIRCUIT

[75] Inventor: Glenn M. Gross, Chicago, Ill.

[73] Assignee: Norlin Industries, Inc., Deerfield, Ill.

[21] Appl. No.: 53,791

[22] Filed: Jul. 2, 1979

[51] Int. Cl.[3] ..... G10H 1/02

[52] U.S. Cl. ..... 84/1.01; 84/1.03; 84/1.24

[58] Field of Search ..... 84/1.01, 1.03, 1.24

[56] References Cited

U.S. PATENT DOCUMENTS

| | | | |
|---|---|---|---|
| 3,929,053 | 12/1975 | Deutsch | 84/1.24 |
| 4,073,209 | 2/1978 | Whittington et al. | 84/1.24 |
| 4,103,581 | 8/1978 | Deutsch | 84/1.24 |
| 4,122,743 | 10/1978 | Tomisawa et al. | 84/1.24 |
| 4,152,966 | 5/1979 | Deutsch | 84/1.24 |
| 4,185,530 | 1/1980 | Robinson et al. | 84/1.24 |
| 4,198,892 | 4/1980 | Gross | 84/1.24 |

*Primary Examiner*—Gene Z. Rubinson
*Attorney, Agent, or Firm*—Ronald J. Kransdorf; Jack Kail

[57] ABSTRACT

A musical instrument tone generator comprises a clock circuit including means for developing an interval code representing the number of musical intervals to be swept by a tone signal. An output clock signal is produced in response to the interval code for causing the swept tone signal to exhibit a rate of change varying exponentially with time such that a number of musical intervals are swept in a corresponding number of equal time intervals. Means are provided for suitably updating the output clock signal in response to the modification of an on-going frequency sweep in order to maintain the foregoing correspondence between the number of musical intervals swept and the time duration of the sweep. In another embodiment, the output clock signal is effective for operating the tone generator for developing a tone signal sweeping one or more musical intervals in an equal time interval.

24 Claims, 13 Drawing Figures

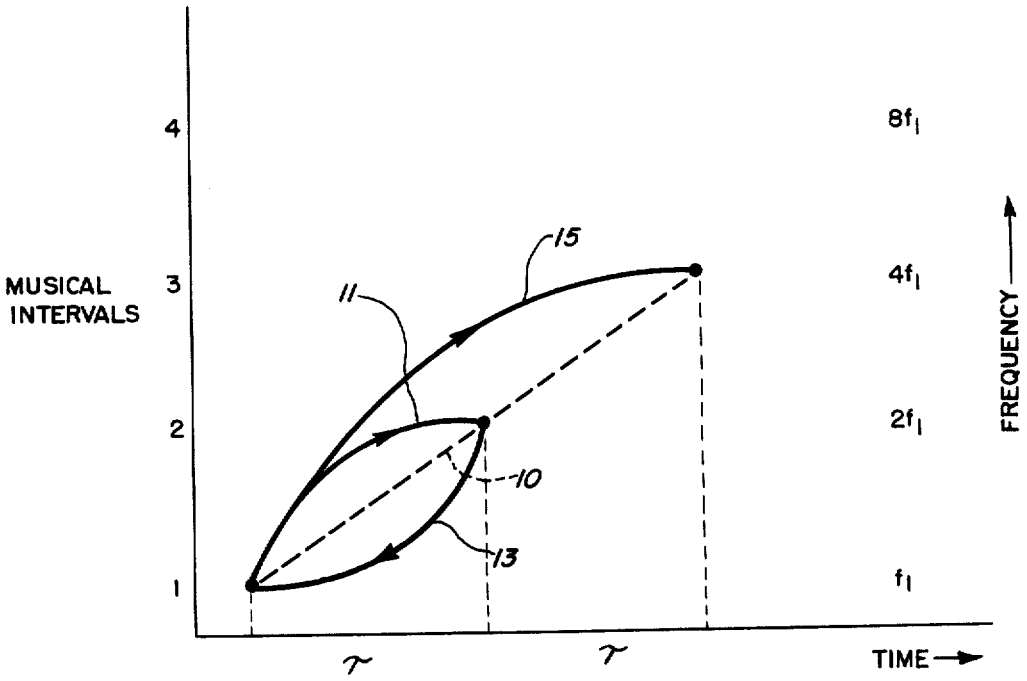
FIG. 1
FIG. 2
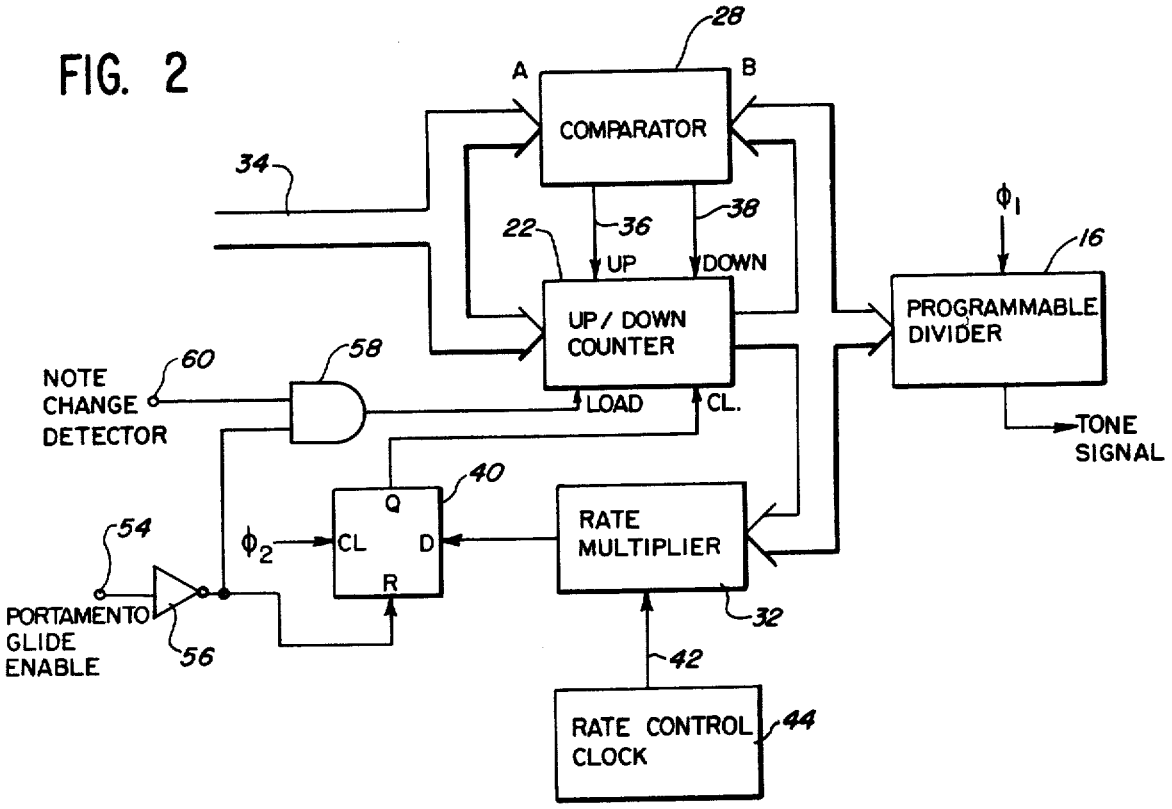

FIG. 5
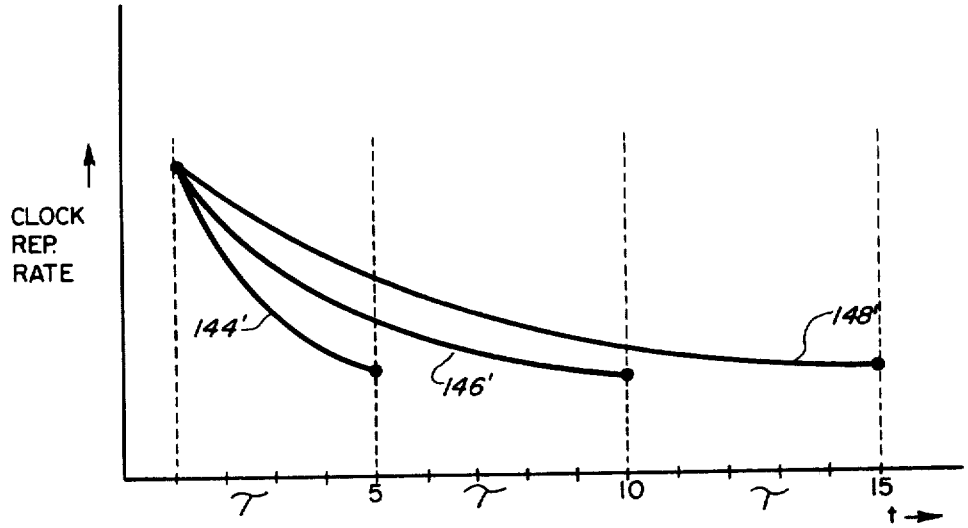
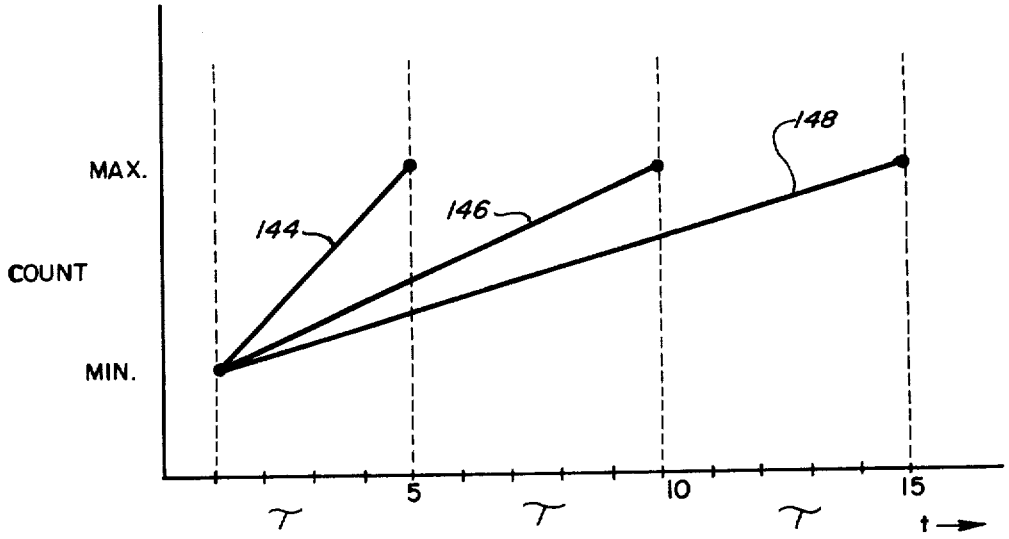
FIG. 4

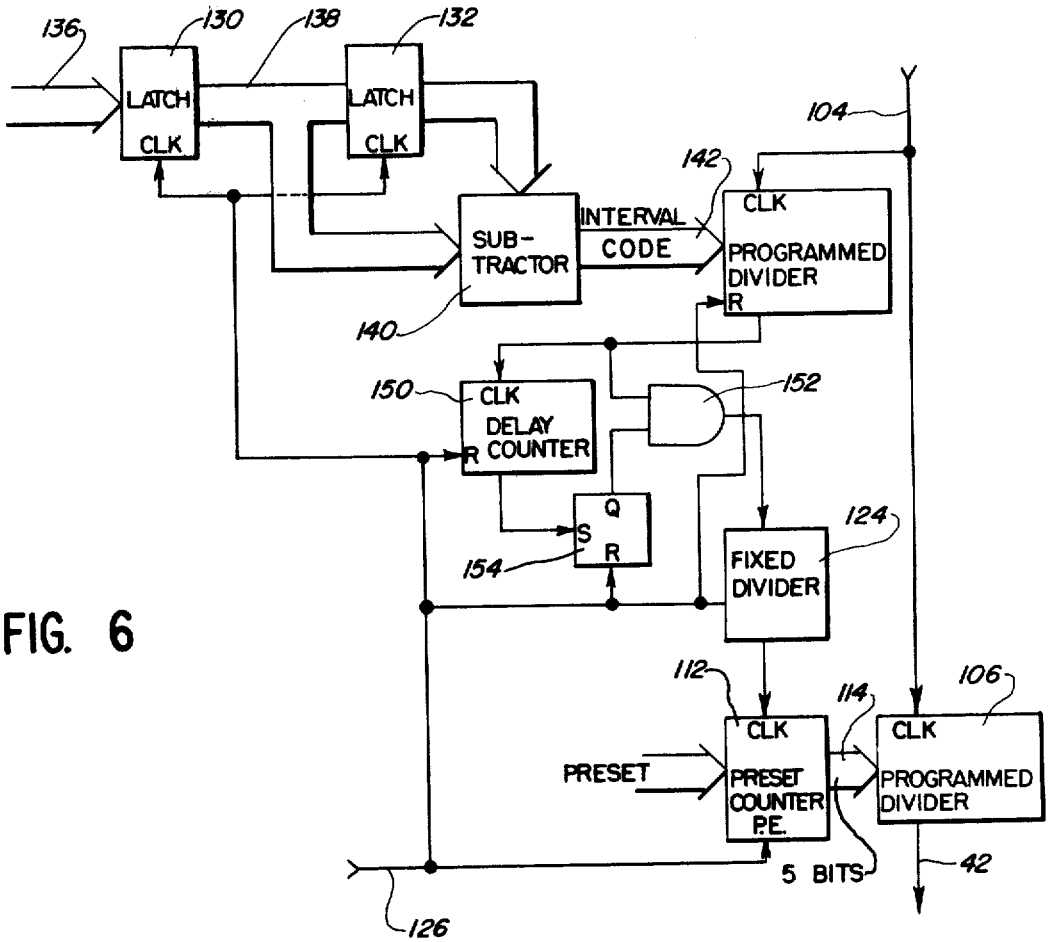
FIG. 6
FIG. 7
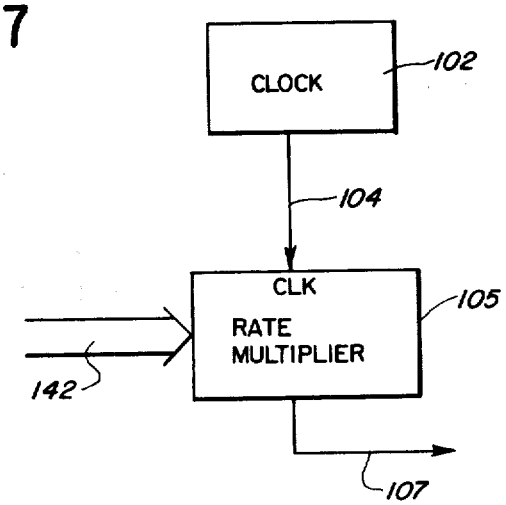

| NOTE | PITCH CONTROL CODE | INCREMENT CODE | ADDRESS |
|---|---|---|---|
| C1 | 61153 | 1 | 1 |
| C#1 | 57720 | 2 | 2 |
| D1 | 54481 | 3 | 3 |
| ⋮ | ⋮ | ⋮ | ⋮ |
| C6 | 1911 | 61 | 61 |
| | 16 BITS | 6 BITS | 6 BITS |

PORTAMENTO AND GLIDE TONE GENERATOR HAVING MULTIMODE CLOCK CIRCUIT

BACKGROUND OF THE INVENTION

The present invention relates to clock circuits and, more particularly, to an exponential clock circuit useful in association with an electronic musical instrument for producing a tone signal having a frequency sweeping one or more musical intervals at an exponential rate.

Copending application Ser. No. 961,222, filed Nov. 16, 1978, in the name of Glenn Gross, which is incorporated herein by reference, discloses a tone generator for an electronic musical instrument adapted for producing various musical effects such as portamento and glissando, both of which comprehend continuously sweeping the frequency of a tone signal through one or more selected musical intervals. The disclosed tone generator includes an up-down counter operated for developing a continuously stepped output signal for controlling the divisor of a programmable frequency divider at whose output is developed the swept tone signals. The up-down counter is clocked by the output of a rate multiplier which has its program inputs connected to the output of the up-down counter and its clock input for receiving a constant repetition rate clock signal from a rate control clock. The effect of the rate multiplier is to compensate system operation such that corresponding musical intervals, e.g. semitones, are swept in equal time intervals and at a linear rate regardless of the relative position of the interval in the musical scale. This compensation effect, as a result of which, a given number of musical intervals will always be swept in a corresponding number of equal time intervals, is achieved as a consequence of coupling to the rate multiplier an equal number of clock pulses for each musical interval swept, the rate multiplier coupling the clock pulses to the clock input of the counter at a reduced repetition rate determined according to the relative position of a swept interval in the musical scale.

In order to minimize the abruptness of the transition occurring at the end of a sweep, it has been found desirable to sweep the frequency of the tone signal at an exponential rather than a linear rate. Such may be accomplished in association with the tone generatior described in the previously mentioned copending application by coupling clock pulses to the rate multiplier which have a repetition rate varying exponentially with time rather than at a constant rate as in the linear case. However, in order to maintain the previously described time correspondence wherein a given number of musical intervals are swept in a corresponding number of equal time intervals, appropriate steps need to be taken to insure that the number of clock pulses coupled to the rate multiplier is directly proportional to the number of musical intervals to be swept. Also, it is desirable that the rate of change of the exponentially varying tone signals should remain substantially constant at the beginning of a sweep regardless of the number of musical intervals to be swept and of the position of the swept intervals in the musical scale. Similar considerations also apply to the rate of change of the tone signals at the end of a sweep.

Yet another consideration involves the condition wherein the musical instrument is operated for modifying a previously initiated frequency sweep prior to its completion. For example, assume that the musical instrument has been operated for and is in the process of generating a tone signal having a frequency sweeping between two values $f_1$ and $f_2$. Now, if prior to the completion of the frequency sweep, the instrument is operated for producing a tone signal having a frequency $f_3$, it would be desirable to provide a capability for enabling the tone signal for being suitably swept from the frequency at which the initial sweep was interrupted to the newly designated frequency $f_3$. The latter sweep to the newly designated frequency should be accomplished in a manner maintaining the previously discussed time correspondence and should also be characterized by an exponential rate of change at its initiation and completion corresponding to the previously mentioned constant values.

SUMMARY OF THE INVENTION

Accordingly, it is an object of the invention to provide a new and improved exponential clock circuit useful in association with an electronic musical instrument tone generator.

It is a more specific object of the invention to provide an exponential clock circuit adapted for operating a musical instrument tone generator for producing tone signals whose frequencies are swept exponentially with time such that a specified number of musical intervals are swept in a corresponding number of equal time intervals.

It is a further object of the invention to provide an exponential clock circuit of the foregoing type which is adapted for operating the tone generator for suitably modifying an on-going frequency sweep in response to a new note assignment.

In accordance with these objects, an electronic musical instrument includes player controlled means successively operable for supplying a binary code comprising a pitch code representing the frequency of a designated note and an associated increment code representing the incremental position of the designated note within the musical scale; a clock circuit responsive to the increment codes associated with first and second successively supplied binary codes for developing a clock signal having a repetition rate which varies exponentially with time according to the number of musical intervals between said increment codes; and a tone generator responsive to the clock signal for developing an output tone signal having a frequency sweeping from the frequency corresponding to the pitch code associated with the first binary code to the frequency corresponding to the pitch code associated with the second binary code. The clock circuit includes means continuously manifesting the increment codes associated with pitch codes corresponding to frequencies assumed by the swept tone signal so as to enable the repetition rate of the clock signal to be modified according to the number of musical intervals between a subsequent increment code and the currently manifested increment code, the subsequent increment code being supplied during the progress of the tone signal sweep between the pitch codes associated with the first and second binary codes.

In another embodiment of the invention, means responsive to the increment codes associated with the first and second successively supplied binary codes develops a clock signal having a repetition rate which varies in direct proportion with the number of musical intervals between said increment codes for operating the tone generator for producing an output tone signal sweeping one or more musical intervals in an equal time interval.

BRIEF DESCRIPTION OF THE DRAWINGS

FIG. 1 graphically illustrates an output tone signal whose frequency is swept through one or more musical intervals at a linear and at an exponential rate of change.

FIG. 2 is a block diagram illustrating a tone generator useful in association with the exponential clock circuit of the invention.

FIG. 4 is a graphical representation of the count developed at the output of the counter in FIG. 3 when sweeping various different musical intervals.

FIG. 5 is a graphical representation of a series of clock signals developed by the circuit of FIG. 3 in response to the count signals shown in FIG. 4.

FIG. 6 is a block diagram of an embodiment of the invention which is capable of generating a clock signal characterized by a linear portion and an exponential portion.

FIG. 7 is a block diagram of an embodiment of the invention for producing a clock signal whose repetition rate is directly proportional to the number of musical intervals being swept.

DESCRIPTION OF THE PREFERRED EMBODIMENT

Figure 3:
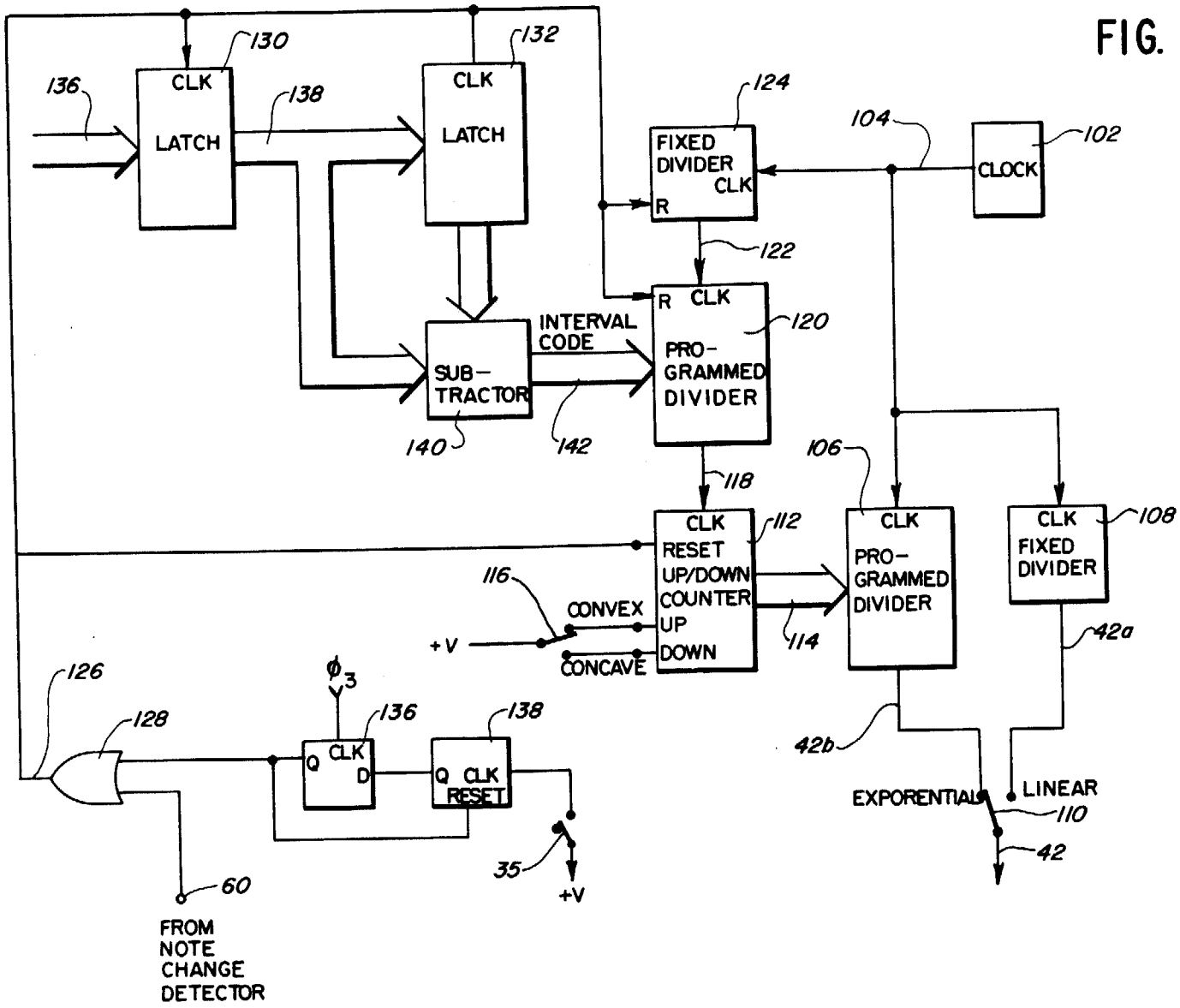
FIG. 3 is a block diagram illustrating a basic embodiment of the exponential clock circuit of the invention.

FIG. 1 graphically illustrates the basic nature of the present invention. As previously discussed, copending application Ser. No. 961,222 discloses a tone generator for an electronic musical instrument adapted for producing a tone signal whose frequency may be linearly swept through one or more musical intervals. Dotted line 10 represents a tone signal whose frequency is swept in this manner. It will be observed that the tone signal may be swept through a first musical interval, defined by the frequencies $f_1$ and $2f_1$, at a linear rate and in a time interval represented by $\tau$. The tone signal may also be linearly swept through a second musical interval, defined by the frequencies $2f_1$ and $4f_1$, also during a time interval represented by $\tau$. Similar results may be achieved when sweeping any other corresponding musical interval in the musical scale such that, on an overall basis, all corresponding musical intervals are linearly swept in equal time intervals.

FIG. 2 generally illustrates an embodiment of the tone generator disclosed in copending application Ser. No. 961,222 which may be operated to realize the foregoing effect. A clock signal $\phi_1$ is applied to the clock input of a programmable divider 16 which acts as a frequency synthesizer to generate an output tone signal in response to a divisor representative program control code developed at the output of an up/down counter 22. The output of counter 22 is, in addition, coupled to an input B of a binary comparator 28 and to the program inputs of a rate multiplier 32.

A sixteen-bit pitch control code, corresponding to a selected musical note, is coupled over a bus 34 to a second input A of comparator 28 and to the preset inputs of counter 22. Comparator 28 operates counter 22 by developing logic signals on a pair of control lines 36 and 38 which are coupled to the count-up and count-down enable inputs of counter 22 respectively, for equalizing the value of the two binary words presented to its A and B inputs. Counter 22 is clocked in response to a signal developed at the Q output of a flip-flop 40, the flip-flop having its D input connected to the output of rate multiplier 32 and its clock input connected for receiving a clock signal $\phi_2$. The reset input of flip-flop 40, together with one input of an AND gate 58, is supplied from the output of an inverter 56 whose input is connected to a terminal 54 which is characterized by a logically high level signal when it is desired to achieve the effects of portamento or glissando. The second input to AND gate 58 is connected to a terminal 60 which goes logically high whenever a new note is selected or assigned for playing. Finally, the clock input of rate multiplier 32 is supplied with a constant repetition rate clock signal developed on the output line 42 of a rate control clock 44.

In operation, the depression of a key of the musical instrument, e.g. the key having a pitch corresponding to a tone signal frequency of $f_1$, results in the development of a logically high level signal at terminal 60 and the presentation of the corresponding pitch control code to the present inputs of counter 22 and the A input of comparator 28. Since terminal 54 is held logically low, a signal is passed through AND gate 58 causing the pitch control code to be loaded into the counter and flip-flop 40 is held in a reset condition. As a consequence, counter 22 receives no clocking pulses and couples a divisor signal to programmable divider 16 identical to the loaded pitch control code. Programmable divider 16 is thereby operated for producing an output tone signal having a frequency $f_1$.

In order to produce a portamento effect from the initial tone signal to a second tone signal, having a frequency of $f_2$, a logically high level signal is coupled to terminal 54 and the pitch control code corresponding to the newly selected tone signal is presented to bus 34. Flip-flop 40 is therefore taken out of reset and clock pulses are couples from rate control clock 44 and rate multiplier 32 to the clock input of counter 22. Since the inputs of comparator 28 are now unequal, counter 22 will be operated in a direction to equalize the inputs of the comparator, which equalization occurs when the output of counter 22 corresponds to the pitch control code developed on bus 34. Counter 22 thereby couples an incrementally changing signal to the divisor input of programmable divider 16 which, in response thereto, develops an output tone signal having a frequency linearly sweeping between $f_1$ and $f_2$.

As explained in more detail in the previously mentioned application, rate multiplier 34, in association with rate control clock 44, is effective for compensating operation of the tone generator to insure that corresponding musical intervals are linearly swept in equal time intervals. As a result, a given number of musical intervals are swept in a corresponding number of equal time intervals. It has been found that it is often desirable to sweep the output tone signal frequency through one or more musical intervals in an exponential rather than a linear fashion as illustrated by curves 11 and 13 in FIG. 1. Such an exponential sweep has the advantage of producing a less abrupt transition at the end of the sweep since the rate of change of the frequency of the tone signal is substantially less than in the linear case.

The tone generator illustrated in FIG. 2 will produce an exponentially swept tone signal when rate control clock 44 is operated for producing clock pulses which vary exponentially with time. However, in order to maintain the previously described time correspondence between corresponding musical intervals, the number of clock pulses coupled to the rate multiplier should remain constant for each musical interval swept regardless of its relative position in the musical scale. When more than one musical interval is being swept, a proportionately larger number of clock pulses must be generated in exactly a proportionately larger period of time so that the rate of change of the clock signal must be inversely proportional to the number of musical intervals being swept. Also, it is preferable that the rate of change at the end of a sweep, as well as at the beginning of a sweep, remains substantially constant regardless of the number of intervals swept. The exponential clock circuit of the present invention provides a clock signal uniquely adapted for achieving these and other results.

FIG. 3 illustrates a basic embodiment of the exponential clock circuit of the invention. A clock 102 producing a constant repetition rate clock signal on an output line 104 supplies the clock input of a programmable divider 106 and a fixed divider 108. The output 42*a* of fixed divider 108 comprises a clock signal characterized by a constant repetition rate while the output 42*b* of programmable divider 106 comprises a clock signal having a repetition rate which varies exponentially with time. The outputs 42*a* and 42*b* may be selectively coupled to rate multiplier 32 by means of a manually operable selector switch 110 so that the tone generator may be operated for producing frequency sweeps which vary either linearly or exponentially with time.

The divisor control inputs of programmable divider 106 are supplied with a signal developed at the output of an up-down counter 112 via a bus 114. Counter 112 includes an up-count enable input and a down-count enable input selectively connectible to a source of positive potential by a means of a manually operable selector switch 116. When switch 116 is operated for enabling the up-count input of the counter, the inflection characterizing the clock signal developed on line 42*b* is convex (curve 11 of FIG. 1) and when operated for enabling the down-count input the resulting inflection is concave (curve 13 of FIG. 1). Counter 112 is clocked in response to a signal developed on the output 118 of a programmable divider 120 which, in turn, is clocked in response to the signal developed on the output 122 of a fixed divider 124. Fixed divider 124 is clocked in synchronism with dividers 106 and 108 in response to the clock signal developed on conductor 104.

The output 126 of an OR gate 128 is connected to the reset inputs of counter 112, programmable divider 120 and fixed divider 124. In addition, the output 126 of OR gate 128 is connected to the clock inputs of a pair of data latches 130 and 132. One input of OR gate 128 is supplied from note change detector terminal 60 while the gate's second input is coupled to a glissando enable switch 35 through a pair of flip-flops 136 and 138. Flip-flops 136 and 138 are operable for passing a single clock pulse $\phi_3$ to OR gate 128 in response to the closure of glissando enable switch 35. Thus, a pulse is developed on the output 126 of OR gate 128 in response to either operation of glissando enable switch 35 or in response to a pulse developed at terminal 60 representative of the assignment of a new note for sounding by the musical instrument.

Latch 130 is operative for storing an increment code developed on a bus 136 in response to the presence of a pulse on output 126 of OR gate 128. The increment code developed on bus 136, which will be described in more detail hereinafter, represents the incremental position within the musical scale of the note simultaneously selected for sounding. That is, assuming the base increment to be one semitone, the lowest pitched note playable by the instrument may be assigned an increment code of 1, the second lowest pitched note an increment code of 2, the third lowest pitched note an increment code of 3, and so on. The absolute difference between two increment codes thereby defines the number of musical intervals, in the present example—semitones, between the associated notes and tone signals. To this end, the increment code stored in latch 130 is coupled from its output via a bus 138 to the input of latch 132 and to the first input of an absolute subtractor circuit 140. On the next occurring pulse developed on output 126 of OR gate 128, the increment code developed on bus 138 is stored in latch 132 and coupled from its output to the second input of absolute subtractor 140. At the same time, latch 130 is also clocked for storing the new increment code representing the note associated with the pulse produced on output 126. Therefore, the playing of a first note results in the increment code associated with the note being initially stored in latch 130. In response to the playing of a second note, or to the operation of glide enable switch 134, the increment code corresponding to the first note is transferred to latch 132 while the increment code corresponding to the second note is stored in latch 130. The two increment codes stored in latches 130 and 132 are coupled to the inputs of subtractor 140 which couples an interval code to the divisor inputs of programmable divider 120 via a bus 142, which interval code represents the number of musical intervals between the first and second notes.

Operation of the circuit of FIG. 3 may be most conveniently explained with reference to the graphical representations of FIGS. 4 and 5. Assume initially that the musical instrument has been operated for producing a tone signal sweeping a single musical interval. As explained previously, this results in an interval code of 1 being coupled to the divisor control inputs of programmable divider 120 over bus 142. Programmable divider 120 will thereby produce a signal on line 118 having a frequency equal to the frequency of the signal developed on line 122 divided by a factor of 1. In other words, programmable divider 120 will have no effect on system operation when only a single musical interval is being swept. The clock signal coupled to counter 112 is therefore controlled solely by the repetition rate of clock 102 and the divide ratio characterizing fixed divider 124.

The divide ratio characterizing fixed divider 124 is selected such that the signal developed on line 122 is effective for clocking counter 112 through a complete count cycle, in either its count-up or count-down mode, in the amount of time in which it is desired for the tone generator of FIG. 2 to produce a tone signal sweeping one musical interval. Assuming that the tone generator is to sweep a single musical interval in a time interval $\tau$, curve 144 of FIG. 4 represents the output of counter 112 in response to the clock signal developed on line 122 and coupled through programmable divider 120 without modification. It will be observed that the output count depicted by curve 144 linearly increases from a minimum count to a maximum count in the time interval $\tau$. The output count represented by curve 144 is coupled via bus 114 to the divisor control inputs of programmable divider 106 which, in response thereto, develops an output signal on line **42*b* represented by curve 144' of FIG. 5. It will be seen that the signal developed on line 42*b* as represented by curve 144' varies exponentially with time wherein its initial rate of change is relatively rapid followed by a much slower rate of change at its terminating point. Moreover, the number of pulses developed on line 42*b* during the time interval $\tau$ is exactly equal to the number of pulses characterizing the constant repetition rate signal produced on line 42*a* in the same time interval. As a consequence, the signal developed on line 42*b* is effective for operating the tone generator illustrated in FIG. 2 for producing an exponentially swept tone signal through a single musical interval (see curve 11 or 13 of FIG. 1). The frequencies of the tone signal defining the swept musical interval are, of course, defined by the pitch control code coupled to the tone generator over bus 34**.

Next, assume that the tone generator is operated for producing a tone signal sweeping two musical intervals. In this case, the interval code developed on bus 142 is equal to 2. The frequency of the signal developed on line 118 for clocking counter 112 is therefore one-half the frequency of the signal developed on output line 122 of fixed divider 124. Counter 112, which is now being clocked at one-half the rate as in the previous example, takes twice as long to complete a full count cycle. Therefore, as represented by curve 146 of FIG. 4, the output of counter 112 increases linearly from its minimum count to its maximum count in a time interval $2\tau$. Programmable divider 106, in response to the count signal produced on bus 114 and represented by curve 146, develops an output signal on line **42*b* represented by curve 146' of FIG. 5. It will be observed that the output of divider 106 comprises a pulsating signal whose repetition rate varies exponentially with time and whose initial and final slopes correspond substantially to the initial and final slopes respectively characterizing curve 144'. In addition, the number of pulses developed on line 42*b* in association with the signal represented by curve 146' is twice that developed in response to the signal associated with curve 144'. The tone generator of FIG. 2, in response to the signal associated with curve 146', therefore produces a tone signal exponentially swept through two musical intervals in a time interval $2\tau$ (see curve 15** of FIG. 1).

Curves 148 and 148' of FIGS. 4 and 5 represent the outputs of counter 112 and programmable divider 106 in response to a frequency sweep covering three musical intervals. In this case, the division ratio characterizing divider 120 is 3 so that counter 112 completes a full count cycle in a time interval $3\tau$. The exponential output signal developed on line **42*b* therefore includes three times the number of pulses as compared to the case where a signal musical interval is swept. It will be appreciated that similar results are achieved when sweeping even greater numbers of musical intervals. In particular, counter 112 is operated for completing one full count cycle in a period of time directly proportional to the number of musical intervals swept. Consequently, the frequency of the signal developed at the output 42*b* of programmable divider 106** varies at an exponential rate of change in inverse proportion to the number of musical intervals swept such that the signal is characterized by a number of pulses which is directly proportional to the number of musical intervals swept.

In the foregoing example, it was assumed that selector switch 116 was operated for enabling counter 112 to count up from a minimum count to a maximum count. With reference to FIG. 1, this results in the exponential rate of change of the swept tone signal taking on the convex configuration illustrated by curve 11. Operation of selector switch 116 for enabling counter 112 for counting down from its maximum to its minimum count results in the production of a swept tone signal having a concave configuration as illustrated by curve 13 of FIG. 1. Except for the difference in curvature characterizing curves 11 and 13, the system illustrated in FIG. 3 operates identically regardless of whether selector switch 16 is in the up-count or down-count position.

It will be observed that in the purely exponential curves 11, 13 and 15 most of the frequency change occurs at the beginning of a sweep with only a relatively small change occurring toward the end of the sweep. For certain applications it has been found desirable to equalize the rate of frequency change to be more nearly uniform over the swept interval. FIG. 6 illustrates a circuit adapted for accomplishing such wherein a clock signal is provided for operating the tone generator of FIG. 2, the clock signal being characterized by a frequency having a linear rate of change during the first half of the interval swept and characterized by an exponential rate of change for the remainder of the interval. In this manner, the rate of change of the frequency of the tone signal is more evenly distributed over the musical interval with a relatively gentle transition being realized at the end of the sweep.

Referring to FIG. 6, latches 130 and 132 and subtractor 140 operate for producing an interval code on bus 142 exactly as described with regard to the circuit of FIG. 3. Also, as in FIG. 3, output 104 of clock 102 supplies the clock input of programmable divider 106 and counter 112, via bus 114, supplies the divisor control inputs of the divider. However, it will be noted that the respective positions of programmable divider 120 and fixed divider 124 have been interchanged with the output of fixed divider 124 being directly coupled to the clock input of counter 112. The output of programmable divider 120 is coupled to the clock input of a delay counter 150 and to the first input of an AND gate 152, the output of the AND gate being coupled to the clock input of fixed divider 124. The second input to AND gate 152 is derived from the Q output of an RS flip-flop 154 whose set input is connected to the output of delay counter 150 and whose reset input, together with the reset input of counter 150, is connected to output 126 of OR gate 128. It will also be observed that the output 126 is coupled to the preset enable input of counter 112 for suitably presetting the counter to a selected value.

In operation, the interval code developed on bus 142 sets the division ratio characterizing programmable divider 120 according to the number of musical intervals to be swept by the tone signal. Since flip-flop 154, together with dividers 120 and 124 and delay counter 150, have been reset by the pulse developed on output 126, the Q output of the flip-flop is logically low inhibiting AND gate 152. The pulses developed at the output of programmable divider 120 are therefore not coupled through AND gate 152 but are effective for clocking delay counter 150. Counter 112, which has been preset to its minimum count in response to the pulse developed on output 126, therefore receives no clock signal and develops on output bus 114 a constant value signal corresponding to the preset number. The signal developed on bus 114 sets the division ratio characterizing programmable divider 106 so that a constant repetition rate signal is produced on output 42 causing the tone generator of FIG. 2 to operate in its linear mode as previously explained. After about one-half of the musical interval has been swept, an overflow pulse is developed at the output of delay counter 150 setting flip-flop 154 and causing its Q output to go logically high. As a result, AND gate 152 is enabled and passes pulses from programmable divider 120 through fixed divider 124 to the clock input of counter 112. Therefore, with AND gate 152 enabled, the circuit of FIG. 6 operates exactly as the circuit of FIG. 3 whereby the signal developed on output 42 of divider 106 is characterized by a frequency which varies exponentially with time for the remainder of the interval.

Since the pulses developed at the output of programmable divider 120 for clocking delay counter 150 have a repetition rate inversely proportional to the number of musical intervals being swept, an overflow pulse is developed at the output of counter 150 for setting flip-flop 154 at the same relative point regardless of the number of intervals being swept. That is, as the number of musical intervals being swept increases, the repetition rate of the pulses developed on the output of divider 120 proportionately decreases. The overflow pulse developed at the output of counter 150 for switching the circuit from its linear to its exponential mode of operation is therefore suitably delayed or advanced in time to insure that switching takes place at the same relative point during a sweep regardless of the number of intervals being swept. Thus, for example, the circuit may be operated such that the first half of each sweep is linear with the second half being exponential regardless of the extent, in terms of musical intervals, of the sweep.

Unlike instruments such as electronic organs and the like wherein it is desired to simulate the effects of portamento and glissando by sweeping a number of musical intervals in a proportional period of time, electronic music synthesizers are typically constructed such that any number of musical intervals are swept in the same period of time. Such an effect can be realized in association with the present invention as illustrated in FIG. 7. The output 104 of clock 102 is coupled to the clock input of a rate multiplier 105 whose program inputs are supplied with the interval code developed on bus 142. In accordance with this arrangement, a clock signal is developed on the output 107 of rate multiplier 105 whose repetition rate is directly dependent upon the number of musical intervals being swept. That is, the repetition rate of the clock signal developed on output 107 is directly proportional to the number of musical intervals being swept so that equal sweep times are achieved regardless of the number of musical intervals being swept. The output 107 of rate multiplier 105 may be coupled directly to the tone generator of FIG. 2 over conductor 42 or, alternatively, may be used in place of the clock signal developed on conductor 104 in the exponential clock circuits of the present invention.

A technique for developing the pitch control codes and increment codes for use with the circuits described herein will now be disclosed.

Figures 8, 9:
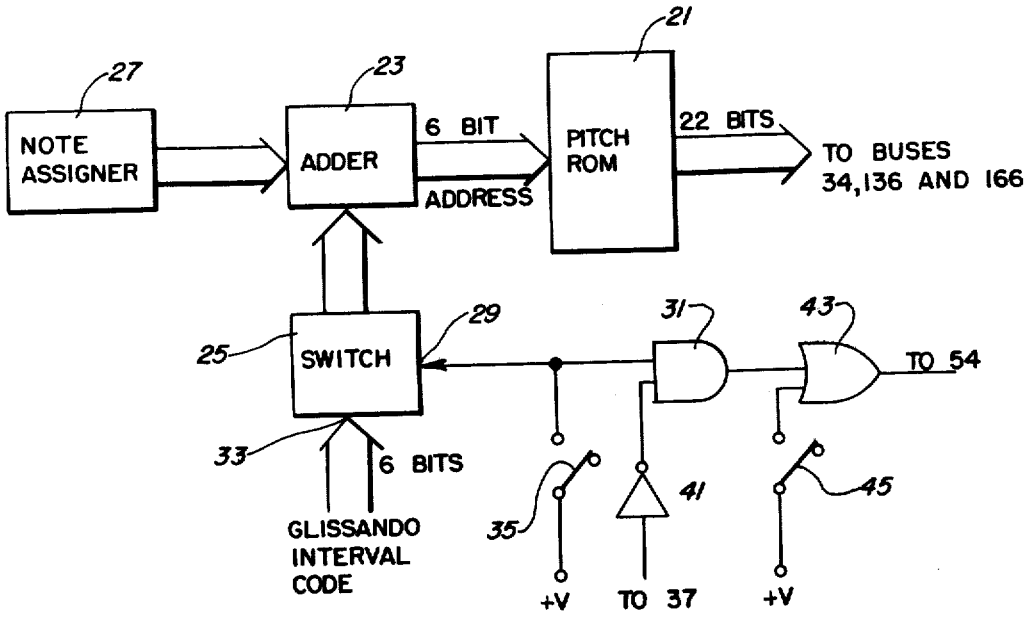
FIG. 8 is a block diagram showing a circuit suitable for developing pitch and increment code signals for operating the exponential clock circuit of the invention.
FIG. 9 is a table illustrating the method of programming the ROM shown in FIG. 8.

Referring to FIGS. 8 and 9, a suitably programmed ROM 21 is addressed by a binary adder 23. The method of programming ROM 21 is shown in FIG. 9 wherein it will be observed that each of the, for example, 61 notes of a conventional musical instrument keyboard is associated with a particular 22-bit memory word comprising a 16-bit pitch control code and an associated 6-bit increment code identical to the address of the memory word. Thus, the selection of a particular ROM address by adder 23 results in the development of the corresponding pitch control code and associated increment code. Pitch control code 61153 (corresponding to pitch C1) and associated increment code 1 would therefore be developed in response to an address signal from adder 23 having a value of 1; pitch control code 57720 (corresponding to pitch C1#) and associated increment code 2 would be developed in response to an address signal having a value of 2; and so on.

The address signals developed by adder 23 are dependent on inputs from a switch 25 and from a note assigner 27. Note assigner 27 may be of conventional design and comprise, for example, a scanned keyboard system outputting a 6-bit address signal identifying an operated key of the musical instrument. Thus, note assigner 27 would couple a 6-bit address signal having a value of 3 to adder 23 in response to operation of the key corresponding to note D1. Assuming, for the moment, no other inputs to adder 23, this address signal (i.e. of value 3) is coupled to ROM 21 by the adder and addresses pitch control code 54481 and associated increment code 3.

Switch 25, which preferably comprises a 6-bit device, includes an enable input 29 connected to the first input of an AND gate 32 and a glissando interval code input 33. Input 33 is supplied with a fixed 6-bit code representative of the desired glissando interval. For example, referring to FIG. 9, a glissando interval code having a value of 2 would correspond to a glissando interval of two semitones.

Enable input 29 of switch 25 and the first input of AND gate 32 are connected through glissando enable switch 35 to a source of positive potential +V. The second input of AND gate 31 is supplied from the A=B output 37 of comparator 28 through an inverter 41. Finally, an OR gate 43, having an output for application to portamento/glissando enable input 54, includes a first input connected to the output of AND gate 32 and a second input coupled through a portamento enable switch 45 to a source of positive potential +V.

In considering the operation of the circuit of FIG. 8, initially assume that it is desired to sound an output tone signal representative of note C1. The key corresponding to note C1 is accordingly depressed whereupon note assigner 27 energizes note change detector input 60 and couples a 6-bit address signal having a value of 1 to adder 23. Since switch 25 is not enabled, the output of adder 23 also has a value of 1 and addresses pitch control code 61153 and associated increment code 1 of ROM 21. The addressed pitch control and increment codes are coupled to buses 34 and 136 and, as previously explained, results in the development of an output tone signal corresponding to note C1. Now, assume that it is desired to produce a portamento effect from note C1 to note D1. This is accomplished by closing portamento enable switch 45 and depressing the key representing the newly selected note D1. Operation of switch 45 results in coupling a logically high level signal through OR gate 43 to portamento/glissando enable input 54 while note assigner 27 couples a 6-bit address having a value of 3 (corresponding to note D1) to adder 23 in response to operation of the newly selected key. It will be noted that switch 25 remains inhibited so that adder 23 also produces an address signal having a value of 3. This address signal addresses pitch control code 54481 and associated increment code 3 which are coupled over buses 34 and 136 to produce the desired portamento effect as previously described. Lastly, consider the production of a glissando effect from the originally sounded output tone signal corresponding to note C1. For the purpose of discussion, it will be assumed that the 6-bit glissando interval code has a value of 2 corresponding to a glissando interval of two semitones. The glissando effect is now realized by closing glissando enable switch 35 and thereby enabling 6-bit switch 25 as well as coupling a logically high level signal to AND gate 31. Switch 25 thereby couples the glissando interval code (of value 2) to adder 23 where it is added to the address developed by note assigner 27 corresponding to the initially selected note C1 (i.e. address value 1). Summating the address from note assigner 27 and from switch 25 therefore results in an address signal from adder 23 having a value of 3 so that pitch control code 54481 and increment code 3 are addressed. It will be observed that the addressed pitch control code corresponds to the note D1 two semitones (the selected glissando interval) above the initial note C1. As before, this pitch control code is supplied to bus 34 and the increment code to bus 136 to produce the desired effect. While, for purposes of clarity, the foregoing examples have been rather rudimentary in nature, it will be appreciated that the principles illustrated apply equally to the production of portamento and glissando effects by the circuit of the invention anywhere in the musical scale and between any selected notes or for any glissando intervals.

Figure 10:
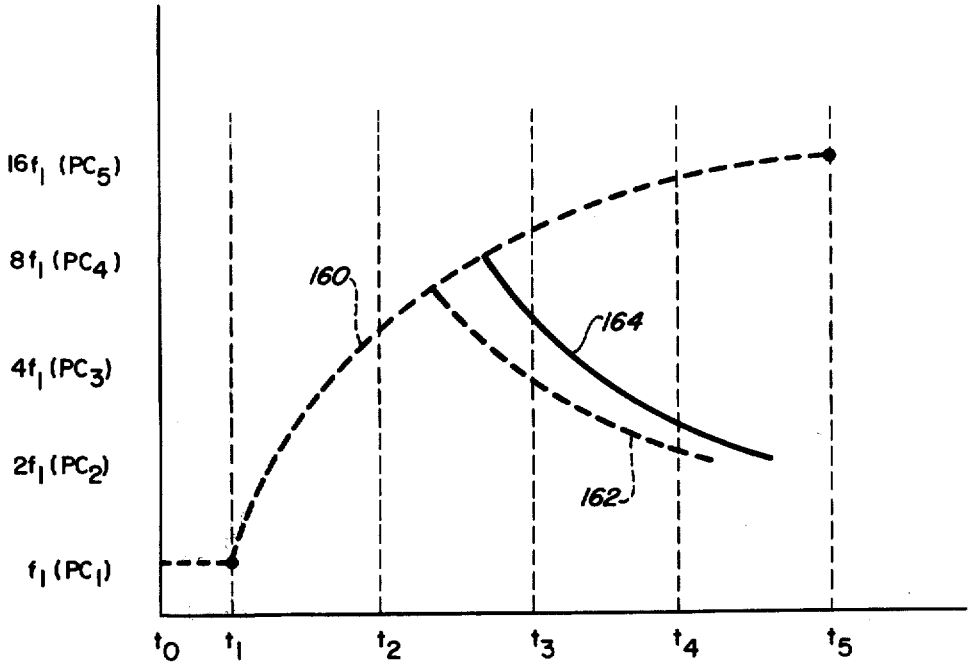
FIG. 10 graphically represents the effect of interrupting a frequency sweep prior to its completion.

Sometimes a sweep is interrupted prior to its completion by, for example, the assignment of a new note, it being intended that the sweep continue from its point of interruption to the newly assigned note. This condition is illustrated in FIG. 10 wherein a dashed curve 160 represents an exponential frequency sweep which the tone generator was initially operated for performing. It will be seen that the sweep representing by curve 160 extends over four musical intervals from a first note corresponding to a tone signal having a frequency $f_1$ to a second note corresponding to a tone signal having a frequency $16f_1$. Assume that prior to the completion of this sweep, the performer depresses the key for sounding the note corresponding to a tone signal whose frequency is $2f_1$. The intent of the performer is, of course, that the sweep represented by curve 160 be interrupted and be continued from the point of interruption to the newly designated note. This latter condition is represented by dashed curve 162. Dashed curve 162 represents an exponential sweep extending from the point at which the sweep represented by curve 160 was interrupted to the newly designated note. At this point, it should be realized that curve 162 represents a desired response and not the actual output of any circuit disclosed herein. In fact, the circuits discussed heretofore, are inherently incapable of producing the sweep represented by curve 162 primarily because they do not reflect the continuing status or progress of the initial sweep represented by curve 160.

Figure 11:
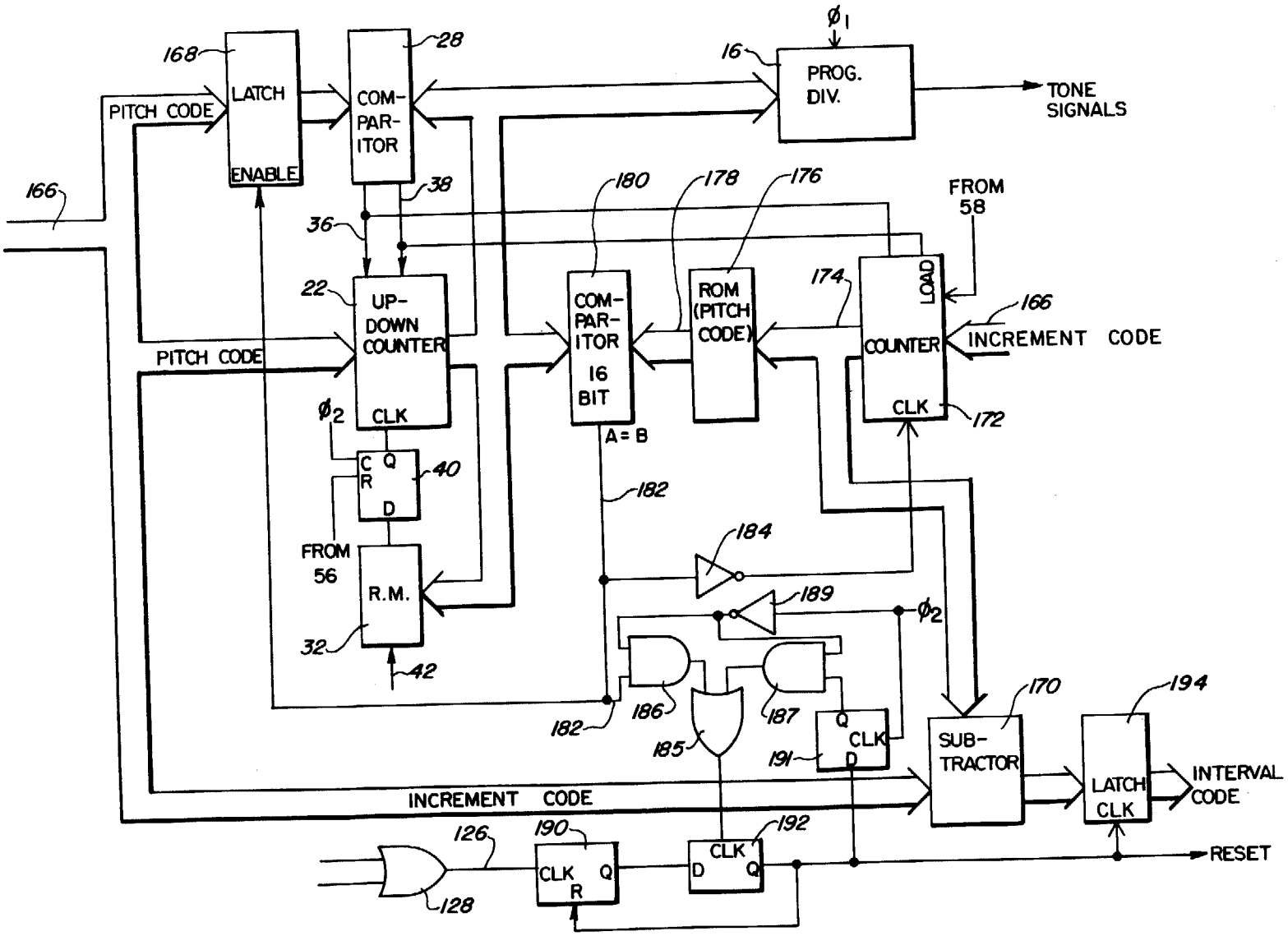
FIG. 11 is a block diagram illustrating an embodiment of the invention adapted for operating a tone generator for properly completing an interrupted frequency sweep.

FIG. 11 discloses an embodiment of the present invention adapted for operating the tone generator of FIG. 2 for developing an exponential sweep approximating curve 162. In FIG. 11, comparator 28, an up-down counter 22, and rate multiplier 32 are arranged as disclosed in the tone generator of FIG. 2. The pitch control code and associated increment code of the assigned note are coupled to a bus 166 which supplies the pitch code to a "pass or hold" latch 168 and to the present inputs of counter 22. Bus 166 also couples the increment code to one input of an absolute subtractor circuit 170 and to the preset inputs of an up-down counter 172. The output of latch 168 is coupled to the A input of comparator 28, the B input of comparator 28 being supplied from the output of counter 22 as before. Latch 168 is operable in response to the state of a logic signal coupled to its enable input over a conductor 182. When the logic signal is high, latch 168 passes data from its input to its output. When the logic signal is low, the latch holds or stores the data presented at its input.

Control lines 36 and 38 of comparator 28 are, in addition to being connected to the up and down count enable inputs of counter 22, also connected to the corresponding inputs of up-down counter 172. Counter 172 includes a load enable input coupled to the output of AND gate 58 of FIG. 2 and an output bus 174. Bus 174 couples signals corresponding to increment codes from the output of counter 172 to the second input of subtractor 170 and to the address inputs of a pitch code ROM 176. The memory of ROM 176 is arranged such that when the ROM is addressed by a particular increment code developed on bus 174, a pitch control code is developed on bus 178 identical to the pitch code with which the addressing increment code is associated. The pitch codes developed on bus 178 are coupled to one input of a comparator 180, the other input of comparator 180 being supplied with the output of counter 22.

Comparator 180 develops a logical 1 signal on output conductor 182 in response to detecting a condition of equality between the signals supplied to its two inputs. Conductor 182 is connected to the enable input of latch 168 and through an inverter 184 to the clock input of counter 172. Conductor 182 is also connected to one input of an AND gate 186, the other input of AND gate 186 being supplied with the alternate phase of clock signal $\phi_2$ through an inverter 189. The output of inverter 189 is also coupled to one input of a second AND gate 187, the other input of the AND gate being derived from the Q output of a flip-flop 191. The outputs of both AND gates 182 and 187 are coupled through an OR gate 185 to the clock input of a flip-flop 192, the D input of which is connected to the Q output of a further flip-flop 190. Flip-flop 190 is clocked in response to the output of OR gate 128 whose inputs are connected to note change detector terminal 60 and through flip-flops 136 and 138 to switch 35. The Q output of flip-flop 192 is, in turn, connected back to the reset input of flip-flop 190, to the D input of flip-flop 191 and also to the clock input of latch 194. The Q output of flip-flop 192 is in addition coupled to the reset inputs of the various dividers and counters as shown in FIGS. 3 and 4.

The data input of latch 194 is connected for receiving the output of subtractor 170 and its output is adapted for developing the interval code which is coupled to programmable divider 120 of FIG. 3 or 6 in place of the signal developed on bus 142. As will be explained in further detail below, the interval code developed by latch 194 is adapted for operating programmable divider 120 for approaching an effect represented by curve 162 of FIG. 10.

Figure 12:
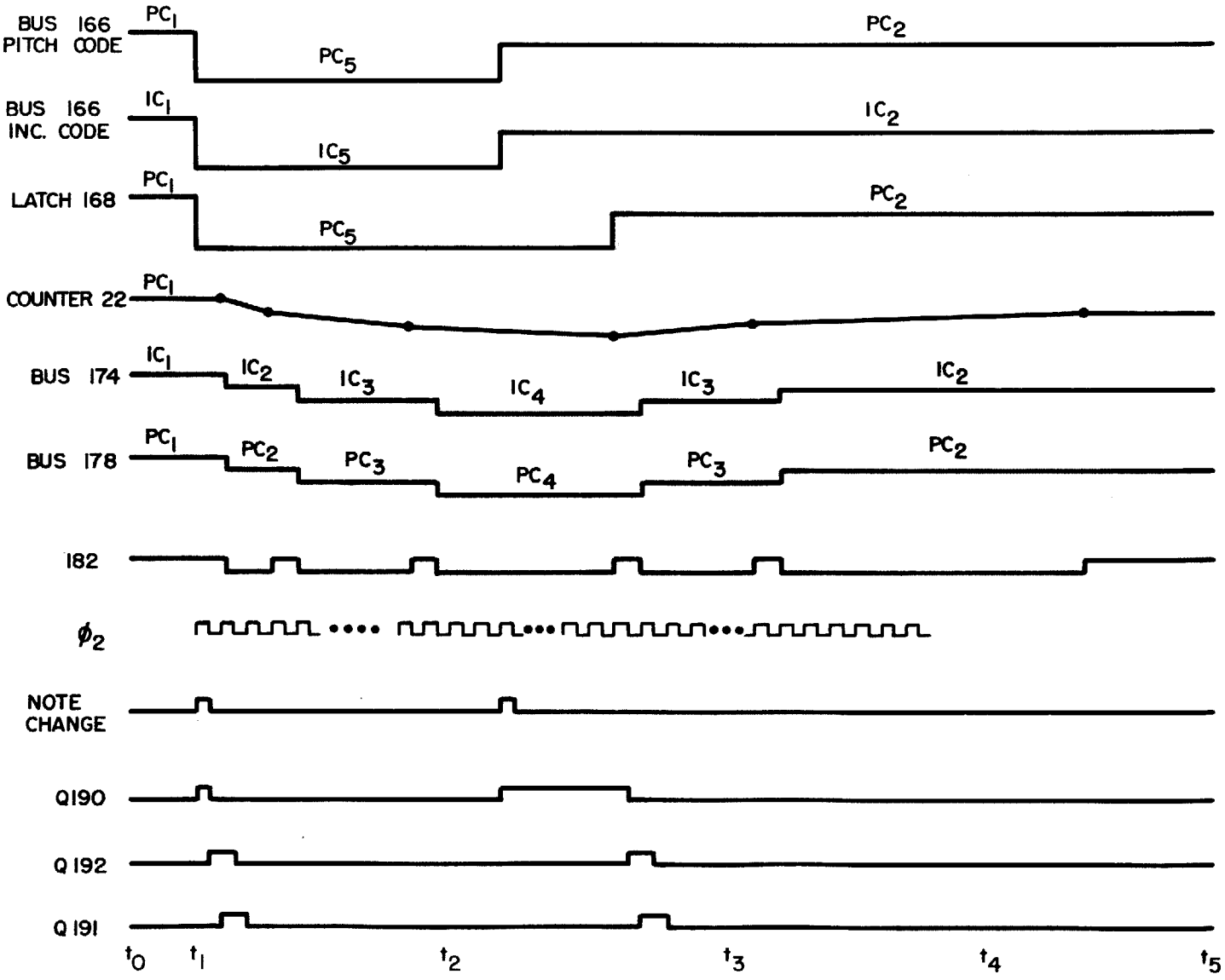
FIG. 12 is a graphical representation of several waveforms encountered within the circuit of FIG. 11.

Operation of the circuit shown in FIG. 11 will be explained in accordance with the exemplary frequency sweep of FIG. 10. Various waveforms illustrating the operation of the circuit are shown in FIG. 12. Referring, therefore, to these figures, at time $t_0$ (i.e. prior to the initiation of the sweep represented by curve 160) the pitch code $PC_1$ is developed on bus 166 together with the associated increment code $IC_1$. Since portamento/-glide enable terminal 54 is logically low, pitch code $PC_1$ is coupled for presetting counter 22 and increment code $IC_1$ is coupled for presetting counter 172. Therefore, the output of counter 22 corresponds to pitch code $PC_1$ and the output developed on bus 174 corresponds to increment code $IC_1$. The increment code $IC_1$ developed on bus 174 is coupled for addressing ROM 176 so that its associated pitch code, $PC_1$, is developed on bus 178. Since the two inputs of comparator 180 are therefore equal, conductor 182 develops a logically high signal and the output of inverter 184 develops a logically low signal. Also, the outputs of flip-flops 190–192 are all logically low.

Now, at time $t_1$ pitch code $PC_5$ and the associated increment code $IC_5$ are coupled to bus 166 and terminal 54 goes logically high indicating that the tone signal is to be swept from the frequency corresponding to pitch code $PC_1$ to the frequency corresponding to pitch code $PC_5$. The note change pulse developed at terminal 60 clocks flip-flop 190 through OR gate 128 causing a logically high signal to be coupled to the D input of flip-flop 192. AND gate 186, which is enabled by the logically high signal on conductor 182, couples the next occurring trailing edge of clock signal $\phi_2$ through OR gate 185 for clocking flip-flop 192. As a consequence, the Q output of flip-flop 192 goes logically high resetting flip-flop 190, presenting a logically high signal to the D input of flip-flop 191 and clocking latch 194. Latch 194 is thusly operated for storing the present output of subtractor 170, which output comprises the difference between increment codes $IC_1$ and $IC_5$. This difference represents the proper interval code for performing the tone signal sweep depicted by curve 160 of FIG. 10. The next occurring rising edge of clock signal $\phi_2$ clocks flip-flop 191 for enabling AND gate 187 which, in turn, couples the next trailing edge of clock signal $\phi_2$ through OR gate 185 for clocking flip-flop 192 to its 0-state. Since the Q output of flip-flop 192 is now logically low, the next occurring rising edge of clock signal $\phi_2$ clocks flip-flop 191 to its O-state. Thus, the Q outputs of flip-flops 109—192 are all logically low again, and will remain so until the next output from OR gate 128, while latch 194 has been set to the proper interval code for the sweep represented by curve 160.

Also, in response to the note change pulse rate multiplier 32, following one period of clock signal $\phi_2$, begins clocking counter 22 for counting down from pitch code $PC_1$ toward pitch code $PC_5$. Comparator 180 is therefore, after a small propogation delay, taken out of its equality indicating status such that the signal developed on conductor 182 goes logically low clocking counter 172. The increment code signal developed on bus 174 is therefore decreased by one increment to increment code $IC_2$ since the counter is being operated in its countdown mode in response to the logically high signal on control conductor 38. Increment code $IC_2$ addresses pitch code $PC_2$ in ROM 176 which is thusly coupled to bus 178. In the meantime, latch 168 is operated for holding pitch code $PC_5$ developed on bus 166 and AND gate 186 is inhibited for passing clock pulses. Upon the output of counter 22 attaining a value corresponding to pitch code $PC_2$, an equality pulse is developed on conductor 182 allowing latch 168 to pass the pitch code developed on bus 166 and enabling AND gate 186. Since the Q output of flip-flop 190 is, however, still logically low, no effect is realized at the output of flip-flop 192. The trailing edge of the pulse developed on conductor 182 also clocks counter 172 causing its output to decrease to a value corresponding to increment code $IC_3$. The new increment code $IC_3$ is coupled by bus 174 for addressing ROM 176 whose output, therefore, corresponds to pitch code $PC_3$. The output of counter 22, at the same time, continues to decrease from pitch code $PC_2$ to pitch code $PC_3$.

When the output of counter 22 reaches pitch code $PC_3$, the foregoing is again repeated whereby another pulse is developed on conductor 182, the output developed on bus 178 is incremented to pitch code $PC_4$ and the output of counter 22 begins decreasing from pitch code $PC_3$ toward pitch code $PC_4$. However, prior to time $t_3$, a new note is designated corresponding to pitch code $PC_2$, it being intended that the ongoing sweep be interrupted and proceed toward a tone signal frequency corresponding to the pitch code $PC_2$. The designation of the new note results in a note change pulse being coupled from terminal 60 through OR gate 188 for clocking flip-flop 190. Therefore, in response to the note change pulse, the Q output of flip-flop 190 goes logically high. Also, the new pitch code $PC_3$ and its associated increment code $IC_2$ are developed on bus 166 and coupled to latch 168 and subtractor 170 respectively. The output of latch 168, however, remains at pitch code $PC_5$ due to the low level logic signal on conductor 182. As a result, even though a new note has been designated, the output of counter 22 continues its sweep toward pitch code $PC_4$.

Slightly prior to time $t_3$ a pulse is developed on conductor 182 indicating the condition of equality between the output of counter 22 and the signal developed on bus 178. The pulse developed on conductor 182 enables AND gate 186 and operates latch 168 for passing pitch code $PC_2$ from bus 166 to the input of comparator 28. The next occurring trailing edge of clock signal $\phi_2$ is therefore coupled by AND gate 186 for clocking flip-flop 192 whose Q output goes logically high clocking latch 194 and resetting flip-flop 190. Latch 194 is consequently updated for storing the current output of subtractor 170, which output comprises the difference between increment code $IC_4$ and increment code $IC_2$. The interval code stored in latch 194 is coupled to programmable divider 120 for developing an appropriate signal on output 42 for clocking rate multiplier 32 for facilitating the performance of the sweep, represented by curve 164 of FIG. 10, back to the tone signal frequency corresponding to pitch code $PC_2$. After latch 194 is thusly updated, flip-flops 190—192 are caused to assume their 0-state as previously described.

The trailing edge of the pulse developed on conductor 182 is again effective for clocking counter 172. However, as the counter is now being operated in its up-count mode, its output increases from a value corresponding to increment code $IC_4$ to a value corresponding to increment code $IC_3$. The addressed output of ROM 176 thereby corresponds to pitch code $PC_3$. Counter 22 is also now being operated in its up-count mode whereby its output sweeps from pitch code $PC_4$ toward pitch code $PC_3$. This process continues until the output of counter 22 has been swept to pitch code $PC_2$ completing the desired sweep.

It will be observed that the frequency sweep represented by the output of counter 22 does not actually follow dashed curve 162 from the point of interruption to pitch code $PC_2$. Rather, the sweep is allowed to continue exponentially following dashed curve 160 until the output of counter 22 reaches pitch code $PC_4$. The sweep then follows solid curve 164 from pitch code $PC_4$ to pitch code $PC_2$. The sweep segment represented by curve 164 covers precisely two musical intervals corresponding exactly to the interval code developed at the output of latch 194.

Figure 13:
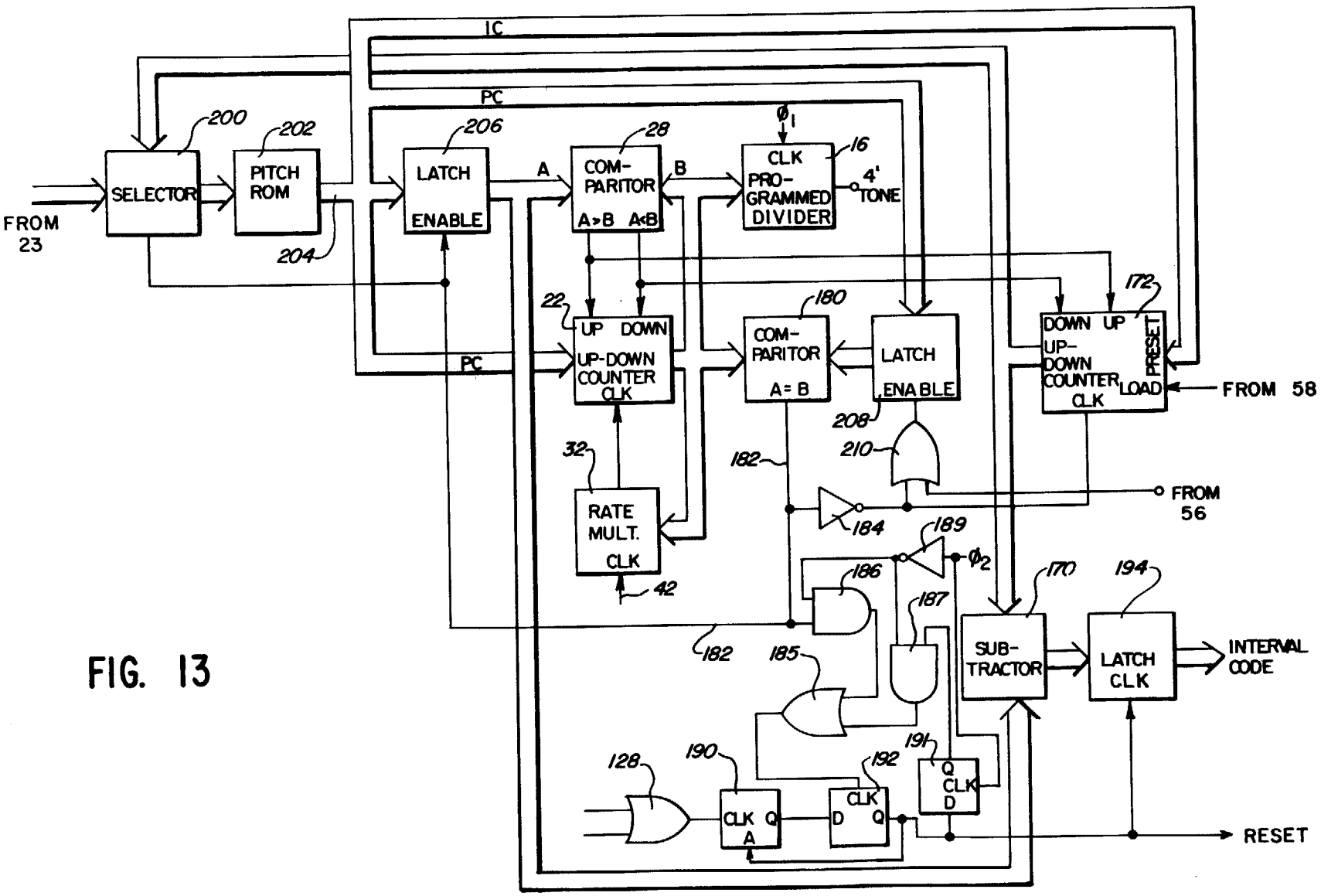
FIG. 13 is a block diagram of another embodiment of the invention whose operation is similar to that of the circuit of FIG. 11.

FIG. 13 illustrates an embodiment of the invention which operates essentially identically to the circuit of FIG. 11 but eliminates the need to duplicate the pitch control memory represented by ROM 176. In FIG. 13, the address of an assigned note is coupled to one input of a selector circuit 200, a second input to selector circuit 200 being derived from the output of counter 172. Selector circuit 200 further includes a control input connected to conductor 182. Selector circuit 200, in response to a logically high signal on conductor 182, couples the note address to a pitch and increment code generator ROM 202 and, in response to a logically low level signal on conductor 182, couples the output of counter 172 to ROM 202. It will be appreciated that ROM 202 is the same memory device otherwise used to operate the tone generator of FIG. 2 and therefore does not involve the duplication of any parts. A bus 204 couples the pitch and increment codes addressed by selector 200 to the input of a first enabling-type latch 206, the pitch code to the input of a second enabling-type latch 208 and to the preset inputs of up/down counter 22, and also couples the associated increment code to the present inputs of counter 172.

The portion of the output of latch 206 representing the increment code developed on bus 204 is coupled to the first input of subtractor 170, the second input to the subtractor being supplied from the output of counter 172. As in the embodiment of FIG. 11, the output of subtractor 170 is coupled to the input of latch 194 for developing the interval code coupled to the programmable divider 120. Except for OR gate 210, which couples signals to the enable input of latch 208 in response to the outputs of inverters 184 and 56, the remaining circuitry shown in FIG. 13 is substantially identical to that of FIG. 11 and will therefore not be discussed in detail.

Referring again to the exemplary sweep of FIG. 10 and the waveforms of FIG. 12, at time $t_0$ selector circuit 200 is operable for coupling the note address corresponding to pitch code $PC_1$ and increment code $IC_1$ to ROM 202. Bus 204 thereby couples pitch code $PC_1$ for presetting counter 22 and increment code $IC_1$ for presetting counter 172. Pitch code $PC_1$ is also coupled to the input of latch 208 which, in response to the logical 1 signal developed at the output of OR gate 210, passes the pitch code to one input of comparator 180. Finally, in response to the logical 1 signal developed on conductor 182, latch 206 couples pitch code $PC_1$ and increment code $IC_1$ from bus 204 to comparator 28 and subtractor 270 respectively. The circuit remains in this condition, producing a tone signal at the output of divider 16 having a frequency of $f_1$ until time $t_1$ when portamento/glide enable terminal 54 is caused to go logically high.

At time $t_1$ terminal 54 goes logically high and the note address corresponding to pitch code $PC_5$ is coupled through selector 200 to pitch ROM 202. Pitch code $PC_5$ is passed by latch 206 to the input of comparator 28 but, due to the logically low output of OR gate 210, latch 208 holds the previous value for pitch code $PC_1$. As the output of counter 22 begins to decrease from pitch code $PC_1$ toward pitch code $PC_2$ in response to clock pulses supplied by rate multiplier 32, the signal developed on conductor 182 goes logically low clocking counter 172 and coupling a logical 0 signal to the enable input of latch 206 and to the control input of selector circuit 200. Latch 206 is therefore operated for holding pitch code $PC_5$ and increment code $IC_2$ developed at the output of counter 172 addresses pitch ROM 202 through selector circuit 200 causing pitch code $PC_2$ to be coupled by bus 204 through latch 208 to comparator 180. Upon the output of counter 22 reaching pitch code $PC_2$, an equality pulse is developed on conductor 182 enabling AND gate 186 and also enabling selector circuit 200 for sampling the note address input. Since a new note has not been designated pitch code $PC_5$ and increment code $IC_5$ are again coupled to bus 204 by ROM 202. As the output of counter 22 decreases below pitch code $PC_2$, a logical 0 signal is again developed on conductor 182 clocking counter 172 for coupling increment code $IC_3$ to selector circuit 200. The logical 0 signal on conductor 182 again causes latch 206 to hold pitch code $PC_5$ and latch 208 to pass pitch code $PC_3$ to comparator 180.

The foregoing process is continously repeated until a new note is designated. In this regard, it will be appreciated that the waveforms of FIG. 12 describe the operation of the circuit of FIG. 13 with the output of latch 206 corresponding to the output of latch 168 and the output of latch 208 corresponding to the signal developed on bus 178. The circuit of FIG. 13 eliminates the need for the additional pitch ROM 176 (see FIG. 11) by alternately addressing ROM 202 through selector circuit 200 in response to note address signals and increment code signals developed at the output of counter 172. The foregoing is facilitated by the logic signals developed on conductor 182 which alternately operate selector circuit 200. In particular, in response to a logical 1 signal on conductor 182, selector circuit 200 couples the note address to pitch ROM 202 while latch 206 is effective for passing the addressed pitch code and associated increment code to bus 204 with latch 208 holding the value of the previous pitch code developed on bus 204. In response to a logical 0 signal on conductor 182, selector circuit 200 couples an increment code address from counter 172 to pitch ROM 202 while latch 208 is effective for passing the addressed pitch code to comparator 180 with latch 206 holding the values of the previous pitch code and increment code developed on bus 204.

The designation of a new note, exemplified by the coupling of a note change pulse to the input of OR gate 128, operates flip-flops 190–192 and latch 194 as previously described with respect to FIG. 11. Consequently, in response to the first trailing edge of clock signal $\phi_2$ after the development of an equality pulse on conductor 182, the Q output of flip-flop 192 goes logically high clocking latch 194 for storing the difference between increment code $IC_4$ (the output of counter 172) and increment code $IC_2$ (the increment code corresponding to the newly designated note developed at the output of latch 206). The output of latch 194 comprises the interval code coupled to divider 120 which is operative for enabling the development of an exponential clock signal on output 42 for application to rate multiplier 32. A tone signal sweep is thereby produced from pitch code $PC_4$ to pitch code $PC_2$ as represented by curve 164 of FIG. 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. In a musical instrument of the type having a tone generator operable in response to a clock signal for developing a tone signal having a frequency sweeping one or more musical intervals, the improvement comprising:

a rate control clock developing an output signal comprising a train of pulses having a constant repetition rate; and means responsive to said rate control clock and to said musical instrument for developing a clock signal for operating said tone generator, said clock signal having a repetition rate which varies exponentially with time at a rate determined according to the number of musical intervals to be swept by said tone signal.

2. In a musical instrument of the type having a tone generator operable in response to a clock signal for developing a tone signal having a frequency sweeping one or more musical intervals, the improvement comprising:

a rate control clock developing an output signal comprising a train of pulses having a constant repetition rate; and means responsive to said rate control clock and to said musical instrument for developing a clock signal for operating said tone generator, said clock signal being comprised of a succession of clock pulses having a repetition rate which varies exponentially with time such that the number of said clock pulses comprising said clock signal varies in direct proportion to the number of musical intervals to be swept by said tone signal.

3. In a musical instrument of the type having a tone generator operable in response to a clock signal for developing a tone signal having a frequency sweeping one or more musical intervals, the improvement comprising:

a rate control clock developing an output signal comprising a train of pulses having a constant repetition rate;

control means responsive to said musical instrument and to said train of pulses for developing a control signal which varies linearly with time at a rate determined according to the number of musical intervals to be swept by the tone signal; and divider means responsive to said train of pulses and to said control signal for developing a clock signal for operating said tone generator, said clock signal being comprised of a succession of clock pulses having a repetition rate which varies exponentially with time at a rate determined according to the rate of change of said control signal with time such that the number of clock pulses comprising said clock signal varies in direct proportion to the number of musical intervals to be swept by said tone signal.

4. The improvement according to claim 3 wherein said control means comprises means for developing said control signal which varies linearly with time at a rate which is inversely proportional to the number of musical intervals to be swept by said tone signal.

5. The improvement according to claim 4 wherein said control means comprises:

means operable for reducing the repetition rate of said train of pulses according to the number of musical intervals to be swept by said tone signal; and counting means clocked in response to said reduced repetition rate train of pulses for developing said control signal.

6. The improvement according to claim 5 wherein said means for reducing comprises the cascaded combination of a fixed ratio frequency divider and a programmable frequency divider, said programmable divider having a divisor control input programmed according to the number of musical intervals to be swept by said tone signal.

7. The improvement according to claim 6 wherein said divider means comprises a further programmable frequency divider having a divisor control input programmed according to said control signal developed by said counting means.

8. The improvement according to claim 7 including means responsive to said musical instrument for developing an increment code identifying the incremental position in terms of musical intervals of each note assignable for sounding by said instrument and means for coupling the increment codes defining the limits of the band to be swept by said tone signal to said control means.

9. The improvement according to claim 8 wherein said control means includes means for storing the values of said limit defining increment codes and subtractor means responsive to said storage means for developing an interval code comprising the absolute difference between said limit defining increment codes, said interval code being coupled to the divisor control input of said programmable divider of said cascaded combination.

10. The improvement according to claim 9 wherein said counting means is selectively controllable for operation in an up-count mode and in a down-count mode for controlling the inflection characterizing the exponential rate of change of said clock signal.

11. The improvement according to claim 9 including delay means connected for operating said cascaded combination for selectively delaying the application of said reduced repetition rate train of pulses to said counting means for a delay interval, said control signal being characterized by a predetermined constant value during said delay interval for causing said clock signal developed by said divider means to exhibit a rate of change which varies linearly with time and to thereafter exhibit a rate of change which varies exponentially with time.

12. The improvement according to claim 11 wherein said delay means comprises means for delaying the application of said reduced repetition rate train of pulses for a delay interval comprising a predetermined fractional portion of the total interval swept by said tone signal.

13. The improvement according to claim 12 wherein said programmable divider of said cascaded combination is clocked in response to said train of pulses from said rate control clock for developing an initially divided signal, said delay means comprising a delay counter clocked in response to said initially divided signal for developing an overflow signal upon being clocked a predetermined number of times and gate means for coupling said initially divided signal to the clock input of said fixed ratio divider in response to said overflow signal, the output of said fixed ratio divider being connected for clocking said counting means.

14. The improvement according to claim 9 wherein said storage means includes means for manifesting the increment code values associated with the notes sounded during the progress of a sweep of one or more musical intervals by said tone signal.

15. The improvement according to claim 14 including means operable for coupling the currently manifested increment code value and a newly designated increment code value to said subtractor means for developing a new interval code for coupling to the divisor control input of said programmable divider of said cascaded combination in response to operating said musical instrument for causing said tone signal to sweep to the note associated with said newly designated interval code, said new interval code comprising the absolute difference between said currently manifested increment code and said newly designated increment code.

16. An electronic musical instrument comprising:

player controlled means successively operable for supplying a binary code which comprises a pitch code representing the frequency of a designated musical note and an associated increment code representing the incremental position in terms of musical intervals of the designated note within the musical scale;

clock means responsive to first and second successively supplied ones of said increment codes for developing a clock signal having a repetition rate which varies exponentially with time according to the number of musical intervals existing between said first and second increment codes; and tone generator means responsive to said clock signal for developing an output tone signal having a frequency exponentially sweeping from the frequency corresponding to the pitch code associated with said first increment code to the frequency corresponding to the pitch code associated with said second increment code.

17. An electronic musical instrument according to claim 16 wherein said clock means comprises means for developing a clock signal which varies exponentially with time at a rate which is inversely proportional to the number of musical intervals existing between said first and second increment codes.

18. An electronic musical instrument according to claim 17 wherein said clock means includes means responsive to said player controlled means for successively providing an indication of the increment codes associated with the pitch codes corresponding to frequencies of said output tone signal as it is swept between the frequencies corresponding to the pitch codes associated with said first and second increment codes.

19. An electronic musical instrument according to claim 18 wherein said clock means includes means responsive to said indication providing means and to a subsequently supplied one of said increment codes for modifying the repetition rate characterizing said clock signal according to the number of musical intervals existing between said subsequently supplied increment code and the increment code then being indicated, said tone generator being responsive to said modified clock signal for sweeping said output tone signal from the frequency corresponding to the pitch code associated with said then indicated increment code to the frequency corresponding to the pitch code associated with said subsequently supplied increment code.

20. An electronic musical instrument according to claim 19 wherein said indication providing means comprises a binary counter, means presetting said binary counter to said first increment code and means for incrementing said binary counter each time said tone signal assumes a frequency corresponding to one of said pitch codes, the output of said binary counter comprising said indicated increment codes.

21. An electronic musical instrument according to claim 20 wherein said means for incrementing comprises memory means addressed by said binary counter and programmed for storing each of said pitch codes in a memory address location defined by its associated increment code and comparator means responsive to the output of said memory means and to said tone generator for incrementing said binary counter in response to a condition of equality between the pitch code developed at the output of said memory means and the pitch code corresponding to a tone signal assumed by said tone generator.

22. An electronic musical instrument according to claim 21 wherein said memory means is programmed for storing one of said pitch codes together with its associated increment code at each of said memory address locations and including means operating said memory means on a time shared basis wherein said memory means is alternately addressed by said binary counter for operating said comparator means and by said player controlled means for supplying said binary codes.

23. In a musical instrument of the type having a tone generator operable in response to a clock signal for developing a tone signal having a frequency sweeping one or more musical intervals, the improvement comprising:

a rate control clock developing an output signal comprising a train of pulses having a constant repetition rate;

means responsive to said musical instrument for developing an interval code representing the number of musical intervals to be swept by said tone signals; and means responsive to said train of pulses for developing an output clock signal comprising a serial succession of clock pulses having a constant repetition rate determined by said interval code for operating said tone generator for developing a tone signal sweeping one or more musical intervals in an equal time interval.

24. A musical instrument according to claim 23 wherein said means for developing an output clock signal comprises a rate multiplier having a clock input connected for receiving said train of pulses and a program input connected for receiving said interval code.

* * * * *